United States Patent [19]

Kipp

[11] Patent Number: 5,004,272

[45] Date of Patent: Apr. 2, 1991

[54] TENDON BOTTOM CONNECTOR FOR A TENSION LEG PLATFORM

[75] Inventor: Robert M. Kipp, Houston, Tex.

[73] Assignee: Shell Oil Company, Houston, Tex.

[21] Appl. No.: 408,004

[22] Filed: Sep. 15, 1989

[51] Int. Cl.[5] ..... F16L 35/00

[52] U.S. Cl. ..... 285/24; 285/307; 285/921

[58] Field of Search ..... 285/18, 315, 322, 323, 285/308, 307, 921, 24, 27; 166/344, 358; 405/202, 208, 224

[56] References Cited

U.S. PATENT DOCUMENTS 3,887,222 6/1975 Hammond ..... 285/307
3,893,717 7/1975 Nelson ..... 285/18 X
4,232,889 11/1980 Putch ..... 285/18 X
4,451,056 5/1984 Galle ..... 285/307 X

*Primary Examiner*—Dave W. Arola

[57] ABSTRACT

A remotely-operable large-diameter underwater tube or tendon connector for securing the hollow legs or tendons of a tension leg platform to an ocean-floor template anchor which is provided with a receptacle for each connector to be used. Each connector includes a latching assembly carried at the end of each tendon which is operated by manipulation of the tendon to alternatively latch the assembly in a receptacle, unlatch it and pull it out of the receptacle, reset the latching assembly, and subsequently latch the connector a second time and later re-releasing it a second time without taking it out of the water.

7 Claims, 5 Drawing Sheets

FIG.1
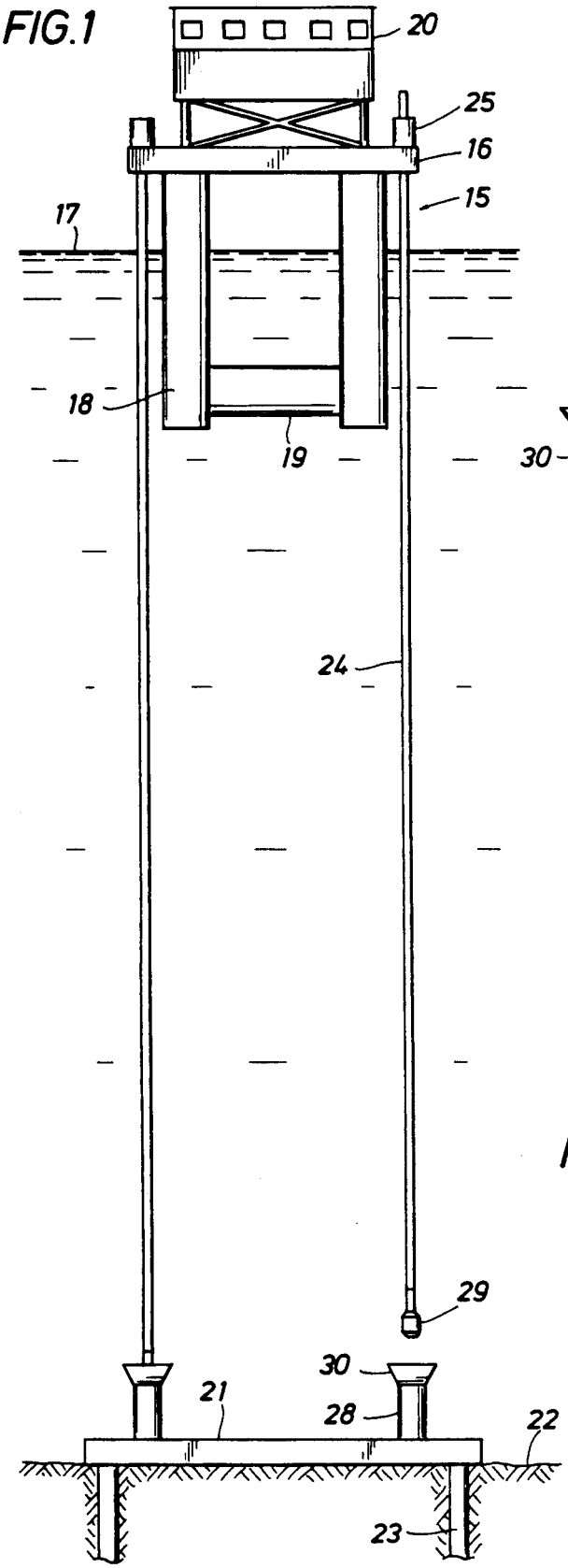
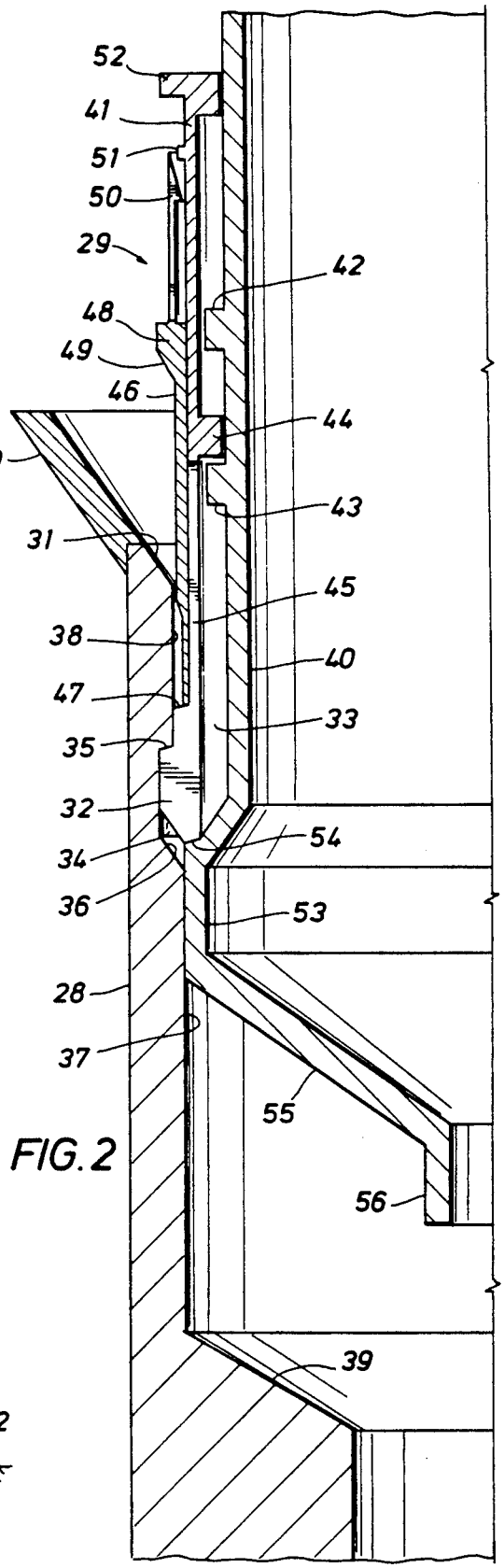
FIG. 2

TENDON BOTTOM CONNECTOR FOR A TENSION LEG PLATFORM

This invention relates to apparatus for remotely connecting and/or disconnecting the legs or tendons of a tension leg platform to or from an ocean floor template or anchor. Tension leg platforms are floating offshore platforms for supporting deepwater marine oil field drilling and production operations in water depths of 1,000 to 8,000 feet or more.

BACKGROUND OF THE INVENTION

From time to time, offshore structures in the form of large offshore platforms are erected on the ocean floor to drill wells therefrom and develop oil and gas-containing formations. The majority of offshore platforms that have been built and are in use today are built as a single rigid structure or unit. One-piece platforms have been constructed and installed in waters up to 1,365 feet. Because of the weight and size of these one piece platforms, it has been found desirable to design lighter structures that may be used in waters that are thousands of feet deep. One form of a newer deepwater platform is known as a tension leg platform which comprises a large platform equipped with buoyancy tanks so that it floats on the surface of the ocean. An ocean floor anchor or template is secured, as by piles, to the ocean floor at the selected location where the platform is to be anchored. The floating platform on the surface is anchored to the ocean-floor anchoring template by a series of anchor lines or tendons which may take the form of flexible lengths of large-diameter pipes, conduits or tubes which are maintained in tension by the buoyancy of the platform.

SUMMARY OF THE INVENTION

The present invention is directed to a remotely-operable large-diameter underwater tube or tendon connector for securing the hollow legs or tendons of an offshore tension leg platform to an ocean-floor anchoring means which may be in the form of a template secured to the ocean floor. There are generally a large number of tendons extending from a floating platform to the ocean floor anchoring template. It is common for a single platform to have as many as a dozen tendons. The tube forming the tendons may be from 2 to 5 feet or more in diameter and may be designed to resist, say, 4 million pounds of tension. In some designs, oil wells may be drilled through the hollow tendons.

Since a tendon might suffer damage during its service life or surface inspection might sometime be desired, provision must be made to be able to disconnect a tendon from its ocean floor anchor and either reconnect that tendon following inspection and repair or replace it with another tendon. In waters up to, say, 1,500 feet deep, the disconnecting of the lower end of a tendon from its anchored position may be carried out by divers. In deeper waters it would be necessary to use an ROV (remotely operated vehicle) or a separately deployed tool to make the disconnection unless a remotely-operable pipe connector was used at the bottom of each tendon.

The present invention is an automatic, self-actuating underwater pipe or tendon connector made up of a two-part connector having one part secured to the lower end of a tendon and adapted to be stabbed into the open upper end of the second part of the connector which is mounted on an ocean floor anchor. The first part of the connector is provided with latches for securing it to the second connector part on downward movement of the latches into said second part. The latches are automatically blocked into a latching groove so as to provide resistance to a pull-apart tension of, say, 4 million pounds or greater.

Further downward pressure on the tendon unlatches the tendon connector so that the tendon may be withdrawn to the surface to be repaired or replaced by a new tendon. Downward movement of the tendon from its tensioned and latched position unlatches the latch-carrying part of the connector and continued downward movement releases a latch-blocking sleeve that holds the latches in an inoperative position to allow the bottom of the tendon to be withdrawn upwardly out of contact with the connector part on the anchor. Upon lowering the end of the tendon and its latching mandrel into the cooperating receptacle a second time, the inoperative and retracted latches are automatically released to once again engage the latching groove after upward movement of the tendon positions the latches opposite the latching groove. The present invention provides a tendon connector which may be remotely connected to an ocean floor anchor by easily achieved vertical manipulation of the tendon from the surface, subsequently released by further tendon vertical manipulation and resetting and reconnecting the tendon to the anchor a second time by further remote manipulation. No rotational manipulation of the tendon is required, although rotation of the tendon does not hinder or detract from operation of the presently disclosed connector.

BRIEF DESCRIPTION OF THE DRAWING

The present invention will be described herein with regard to the drawing wherein FIG. 1 is a diagrammatic longitudinal view of a tension leg platform anchored in a position to the ocean floor, FIG. 2 is a partial cross-sectional view of one form of the tendon connector of the present invention.

DESCRIPTION OF A PREFERRED EMBODIMENT

Figure 3:
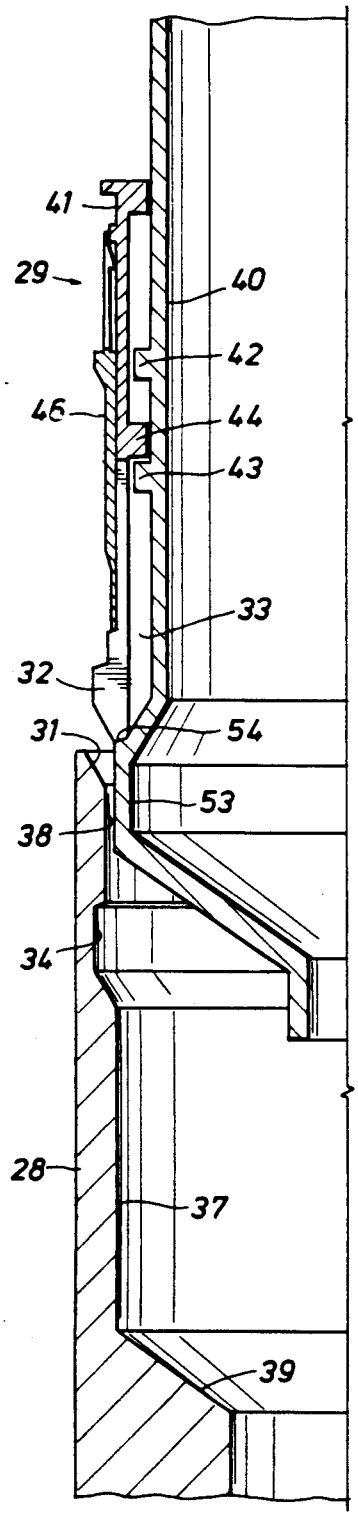
FIGS. 3, 4 and 5 are partial diagrammatic views taken in cross section illustrating sequential movements of the connector latching assembly during a stab and latch operation.

Referring to FIG. 1 of the drawing, one form of a tension leg platform 15 is shown as being provided with a deck 16 supported above the water surface 17 by any suitable arrangement of a buoyant substructure which may consist of a plurality of buoyant legs 18 and buoyant cross-bracing members 19. Equipment such as a crews quarters and operations building 20 are shown as being positioned on the deck 16.

The tension leg platform 15 is shown as being positioned above an ocean floor anchoring means which may take the form of a template 21 through which a plurality of wells may be drilled to develop an offshore oil and/or gas field. The anchoring template 21 was previously placed on the ocean floor 22 and suitably anchored in place in any suitable manner, as by drilling or diving piles 23 into the ocean floor 22 and securing the piles 23 to the template 21.

The tension leg platform is held in location above the ocean floor template by a plurality (say, 4 to 20 or more) of anchor means preferably in the form of tendons 24 which may be long tubes extending from the platform 15 to the template 21. The upper ends of the tendons 24 may be secured to the platform in any suitable manner, as by tensioning/lock apparatus 25 mounted on the deck 16 or elsewhere on the platform. The tendons 24 are in the form of a long (1,000 to 8,000 feet or more) large-diameter (2 to 4 feet or greater) tube which is normally made up of a number of short sections of tubular material connected together end-to-end in any suitable manner. The buoyancy of the tendons may be adjustable with tension being maintained on all tendons 24 by the buoyant vessel or platform 15.

The lower end of each tendon 24 is secured in a readily releasable manner to the template anchor 21 by means of the tendon connector of the present invention as described and claimed herein with regard to FIGS. 2 through 13. The underwater-actuatable and remotely-connectable and releasable tendon connector of the present invention comprises two portions, one portion being connected to the lower end of a tendon and sized for sliding axial movement into another portion in the form of a cylindrical receptacle 28 having an open top end for receiving therein the latching assembly 29 (FIG. 1) carried at the lower end of the tendon 24. The receptacle 28 may have a flared upper end, as at 30, to facilitate the stabbing of the latching assembly 29 into the receptacle 28. The receptacle 28 is secured to the template anchor 21 in any suitable manner and at any predetermined location. Since the platform 15 may be 200 feet or more on a side, the spacing of the receptacles 28 would be of the same order.

Referring to FIG. 2 and reading from the top down, the upper end of the cylindrical receptacle 28 is provided with an inwardly-directed camming surface 31 for camming latches 32 inwardly into an annular recess 33 formed in the tubular latching assembly 29. A circumferential latching groove 34 is provided in the inner wall of the receptacle 28 at a selected distance below the top camming surface 31. The latching groove 34 is at least of a depth and length to receive the latches 32 therein when the latches are moved down to a position opposite the groove.

The upper wall or surface 35 of the groove 34 may be sloped upwardly and inwardly slightly if it is planned to make a tendon release after making the initial connection. Thus, on the release of the connection the surface 35, if sloped, would serve as a camming surface to move a latch 32 radially inward if it was not blocked from moving. If only a single latching and unlatching of the connector is desired, the surface 35 of groove 34 may be horizontal or sloped as described hereinabove. The lower surface 36 of the groove 34 is sloped downwardly and inwardly to form a camming surface for the latch 32.

The bore 37 of the receptacle 28 below the latching groove 34 is slightly reduced in diameter from the bore 38 above the groove 34 for purposes of unlatching the tendon connector. Further down the bore 37, the receptacle 28 may be provided with a stop in the form of a seating shoulder 39 which is sized to limit the downward movement of the tubular mandrel 40 of the latching assembly 29. The upper end of the latching assembly mandrel 29 is secured, by means of welding or by a mechanical connection in a manner similar to the joining of the tendon segments, to the lower end of a tendon 24.

The latching assembly 29 is of a diameter to fit closely within both bores 37 and 38 of the receptacle with the spread of the latches 32 in their inoperative position being greater than the diameter of the upper bore 38. A latching sleeve 41 surrounds and is carried by the assembly mandrel 40 for limited sliding axial movement thereon. Stop elements 42 and 43 are provided on the outer surface of the sleeve 41 to limit the up-and-down movement of a stop 44 on the inner wall of the sleeve 41.

The latching sleeve 41 is provided with a plurality of downwardly-extending spring collet (or cantilever beam) fingers 45 which are secured to the latches 32 and provide the latches 32 with limited radial movement relative to the axis of the mandrel 40.

A latch hold-back sleeve 46 is slidably mounted on the outside of the latching sleeve 41 and is independently axially movable so as to normally rest on the upper surface 47 of the latch 32. The upper end of the latch hold-back sleeve 46 is provided with a stop or shoulder 48, the lower surface 49 of which will contact the camming surface 31 at the top of the receptacle 28 and prevent further downward movement of the sleeve 46. Extending upwardly from the top of sleeve 46 are a plurality of spring collet latching fingers 50 adapted to engage a cooperating outwardly-extending latch ring 51 carried on the outer surface of the latching sleeve 41 near the upper end thereof. An outwardly-extending element 52 may be provided at the top of latching sleeve 41 for being engaged by a diver, or an ROV, or any other mechanism for pulling up the latching sleeve 41 to unlatch the tendon connector as a secondary means or in an emergency.

The lower end of mandrel 40 is enlarged in diameter, as at 53, to fit snugly within the reduced bore 37. A blocking shoulder 54 is formed at the top of the enlarged portion 53 and is profiled to mate with the bottom of the latch 32 when it is in the annular groove 34. This blocking action of the shoulder 54 prevents the lower ends of spring collet fingers 45 and the latches 32 from moving into the recess 33 while tensile loads are applied to the tendon. The lower end of the mandrel 40 may be configured, as at 55, to mate with the stop shoulder 39. The lower end of the mandrel 40 may be formed as or provided with a small diameter length of pipe to form a stinger 56 which would aid in stabbing the tendon connector latching assembly 29 into the ocean floor receptacle 28, as shown in FIG. 1. The stinger might be greater than shown in FIG. 1 or stinger 56 could be omitted.

Figure 4:
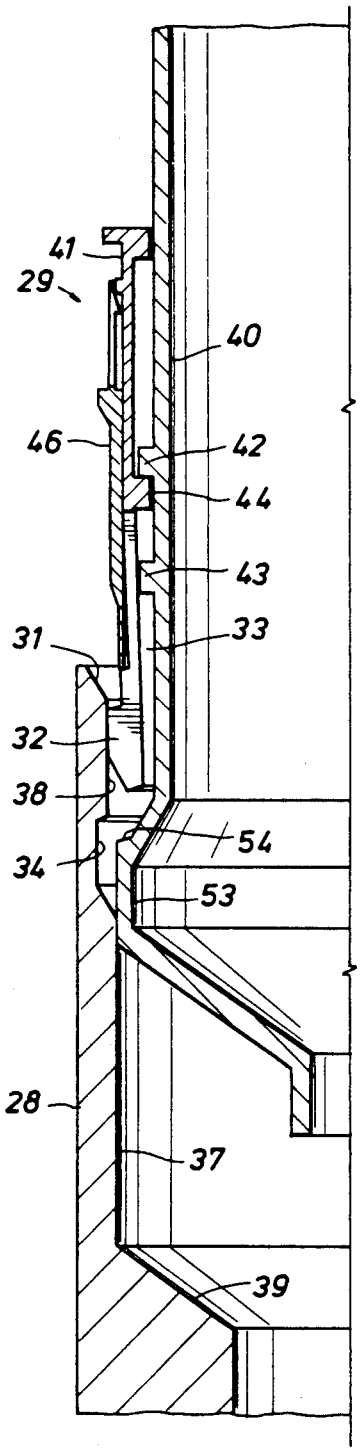
Figure 5:
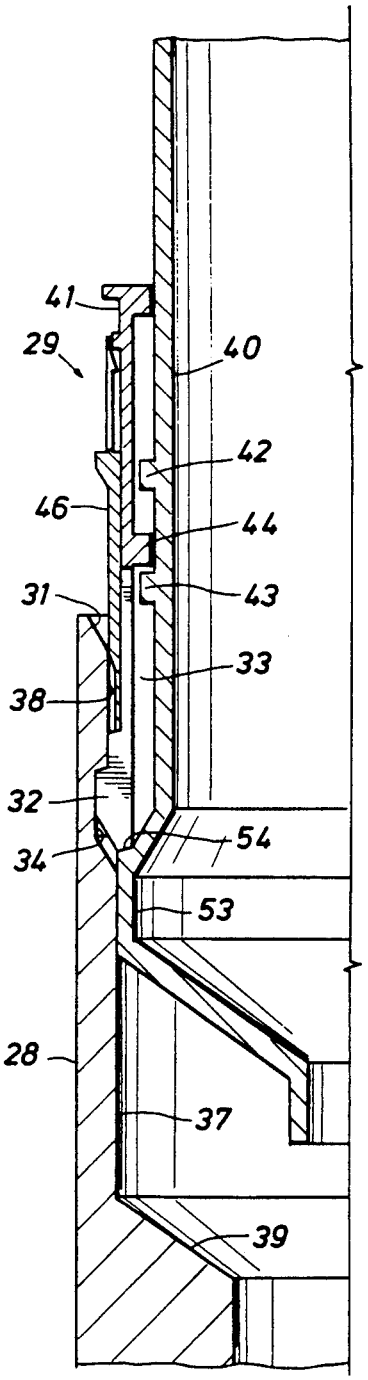

The sequential steps in the movement of the elements of the present underwater tendon connector are shown in FIGS. 3 through 5. FIG. 3 illustrates the first stab of the latching assembly 29 at the bottom of a tendon 24 into the top of a receptacle 28 on the ocean floor template 21. As the assembly moves downwardly from the position shown in FIG. 3, each latch 32 contacts the camming surface 31 at the upper end of the receptacle 28 and slides down the bore wall 38 while being forced radially into the annular recess 33 formed on the outside of mandrel 40 (FIG. 4). In FIG. 5 the latch 32 has been forced downwardly to a position opposite the annular latching groove 34 and the spring collet finger 45 at the top of the latch 32 has snapped the latch 32 into the groove 34. Tension applied from the tendon 24 to the mandrel 40 connected thereto pulls the blocking shoulder 54 up against the bottom of the latch 32 to prevent the latch from moving out of groove 34 and into the recess 33.

In FIG. 4 the latch 32 has entered the bore 38 of the receptacle and friction with the inner wall of the receptacle causes the latching sleeve 41 to slide up on the mandrel 40 until stop 44 on the sleeve 41 hits the stop 42 on the mandrel 40. The latch 32 and the latch hold-back sleeve 46 are sized so they do not engage at this time to block any radial outward movement of the latch. After the latch 32 engages the groove 34 (FIG. 5) the mandrel 40 is pulled upwardly and tension is applied.

Figure 6:
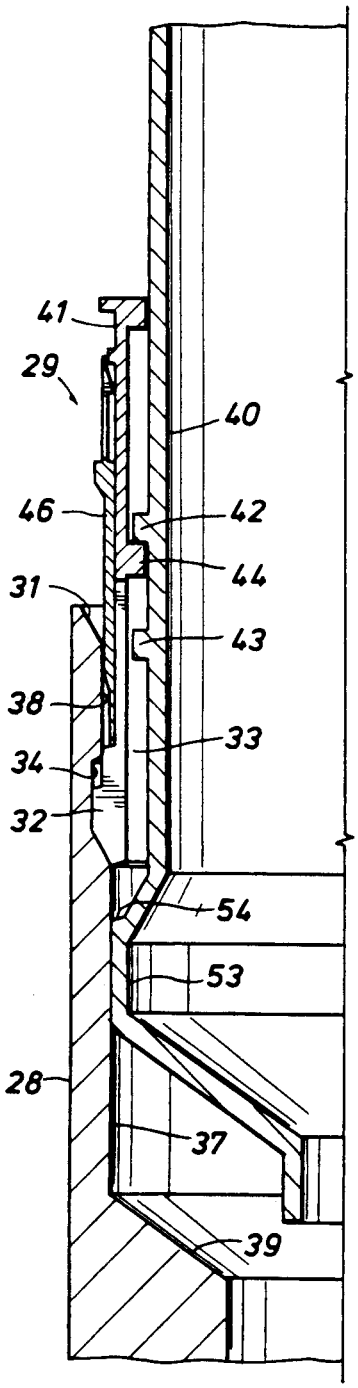
FIGS. 6, 7 and 8 are partial diagrammatic views taken in longitudinal cross section showing the sequential movements of elements of the latching assembly during the unlatching and subsequent withdrawal of the inoperative latching assembly.
Figure 7:
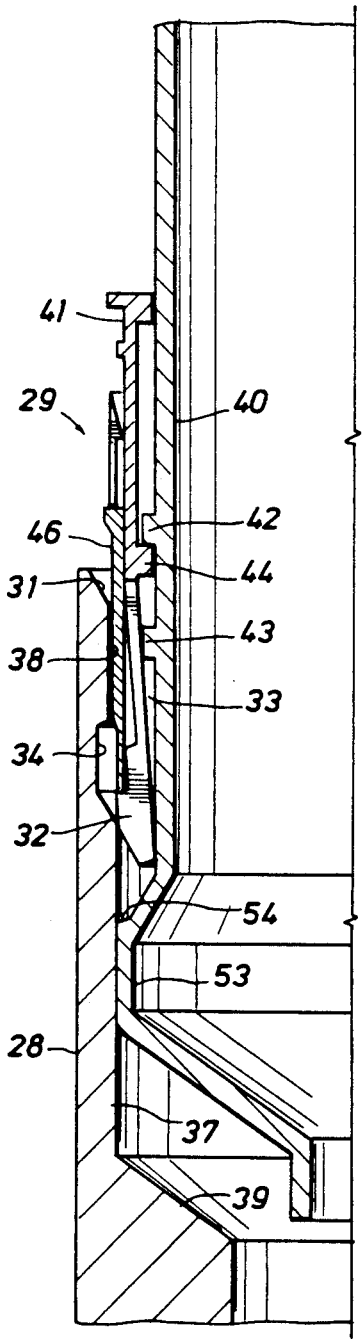
Figure 8:
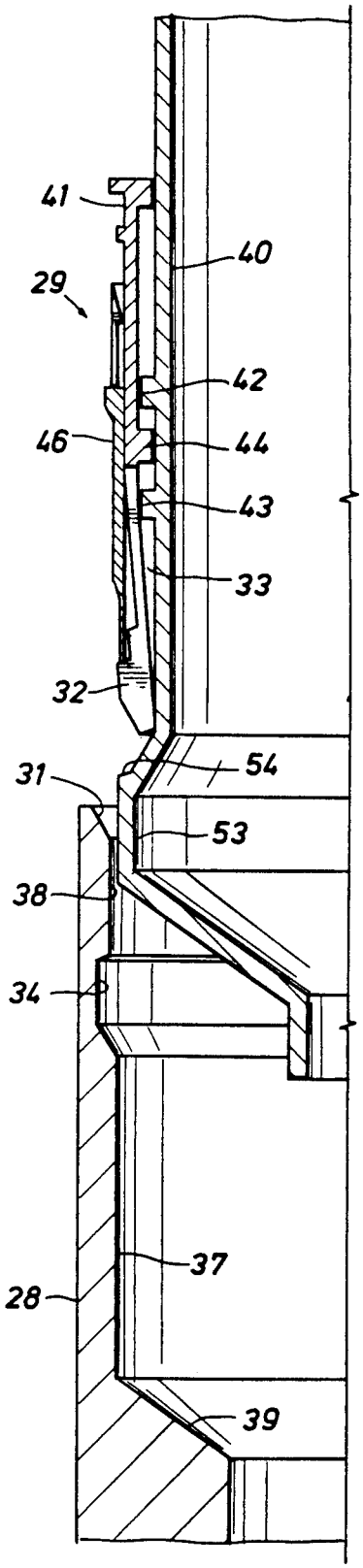

FIGS. 6 through 8 illustrate a release of the present connector using the latch hold back sleeve 46, and subsequent recovery of the tendon 24 and its latching mandrel 40. In FIG. 6 the tendon mandrel 40 has been forced downwardly so that the mandrel stop 42 contacts stop 44 on the latching sleeve 41, driving the latch 32 downwardly. The bottom of the latch 32 contacts the camming surface 36 at the bottom of groove 34 to cause the latch to be driven radially on its spring collet finger into the annular recess 33 on the mandrel 40.

Since the lower bore 37 is smaller in diameter than that of the upper bore 38, the latch is moved radially further into the groove 33 than it did with regard to FIG. 4. This additional movement allows the latch hold-back sleeve 46 to drop down by gravity in front of a portion of the latch 32 to block the latch 32 into its inoperative position on the mandrel 40, as shown in FIG. 7. If desired, a spring may be used to assist in the motion of latch hold-back sleeve 46. The unlatched latching assembly 29 may then be withdrawn from the receptacle 28 (FIG. 8). The latching sleeve 40 and latch 32 together with latch hold-back sleeve 46 drop slightly on the mandrel 40 until the latch 32 contacts the bottom of recess 33 as the tendon latching assembly is withdrawn from the receptacle.

Figure 9:
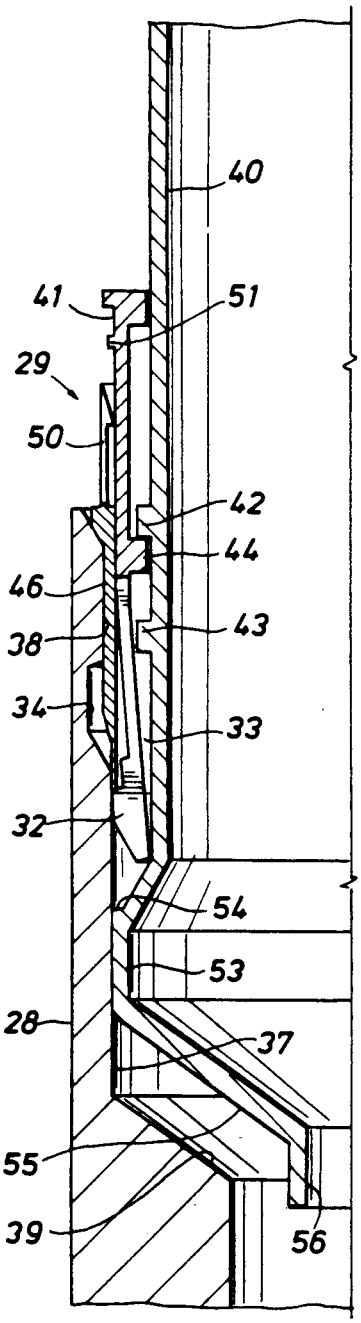
FIGS. 9, 10 and 11 are partial diagrammatic views taken in longitudinal cross section showing the sequential movements of elements of the latching assembly as the assembly is reset to an operational mode and subsequently re-latched to re-connect the tendon connector.
Figure 10:
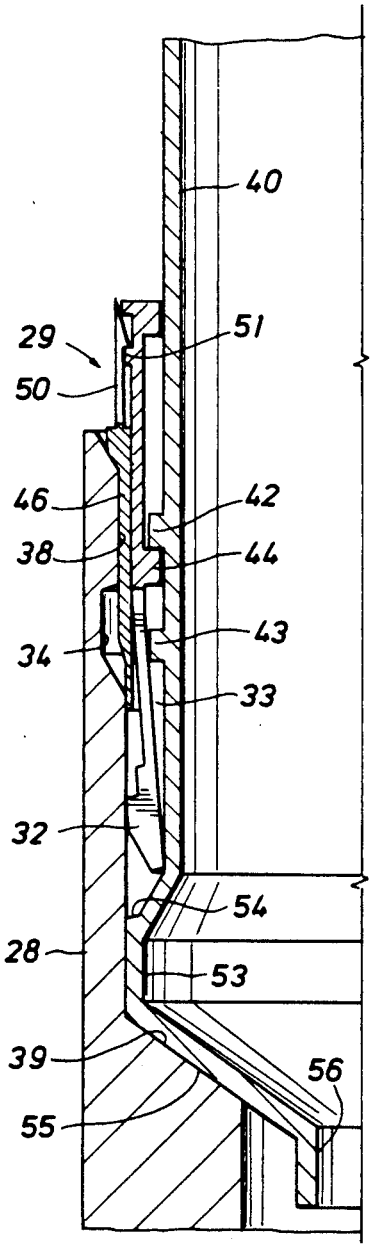
Figure 11:
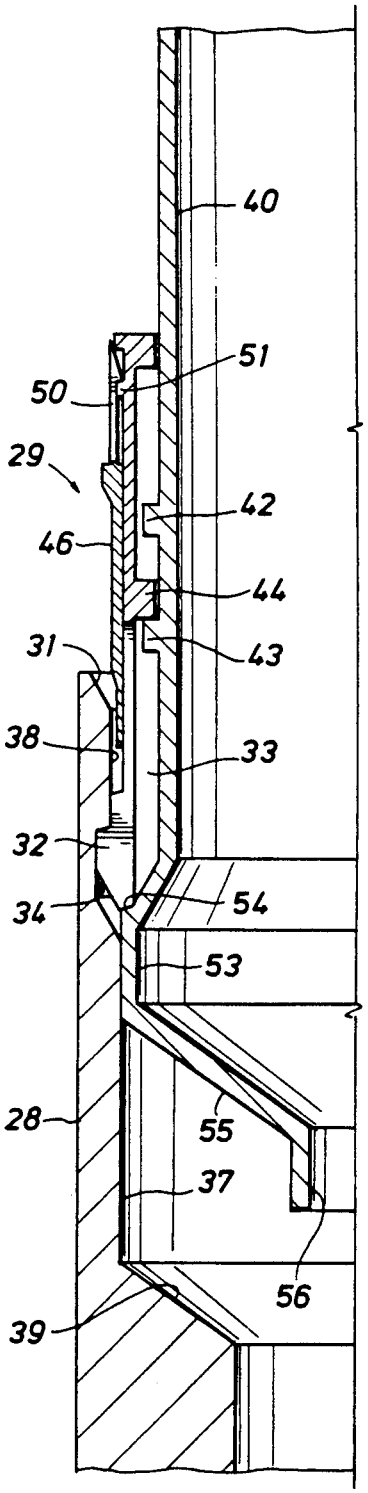
Figure 12:
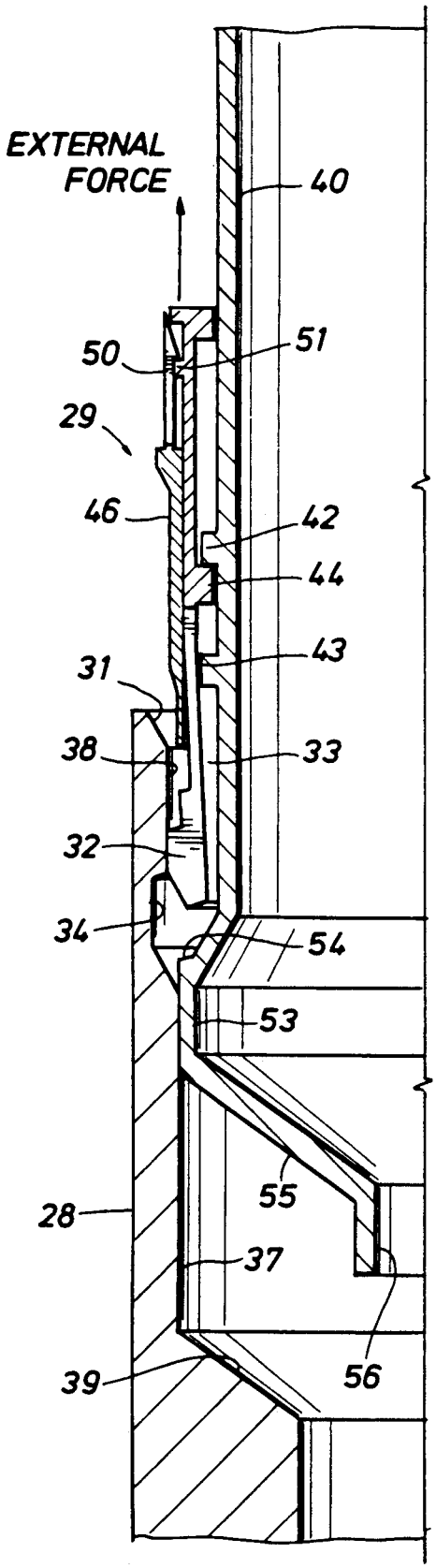
FIGS. 12 and 13 are partial diagrammatic views taken in longitudinal cross section showing the position of the latch assembly elements during a second release of the latching assembly so as to disconnect the tendon connector.

The tendon latching assembly 29 of FIG. 8 may be relatched at any time as shown in FIGS. 9 through 11. The latching assembly 29 is stabbed into the receptacle 28 to some distance (about 18 inches is shown) beyond the latched and pretensioned position shown in FIG. 5. This brings the shoulder 48 of the latch hold-back sleeve 46 into contact with the top of the receptacle 28. Additional lowering of the tendon mandrel 40 together with latching ring 51 on the latching sleeve 41 to a point where it locks on to latching spring finger 50 carried at the top of the hold-back sleeve 46 (FIG. 10). At this time the latch 32 has been withdrawn from engagement with the latch hold-back sleeve 46 so that it is free to move radially outwards into the latching groove 34 upon moving upwardly in the bore of the receptacle (FIG. 11).

Figure 13:
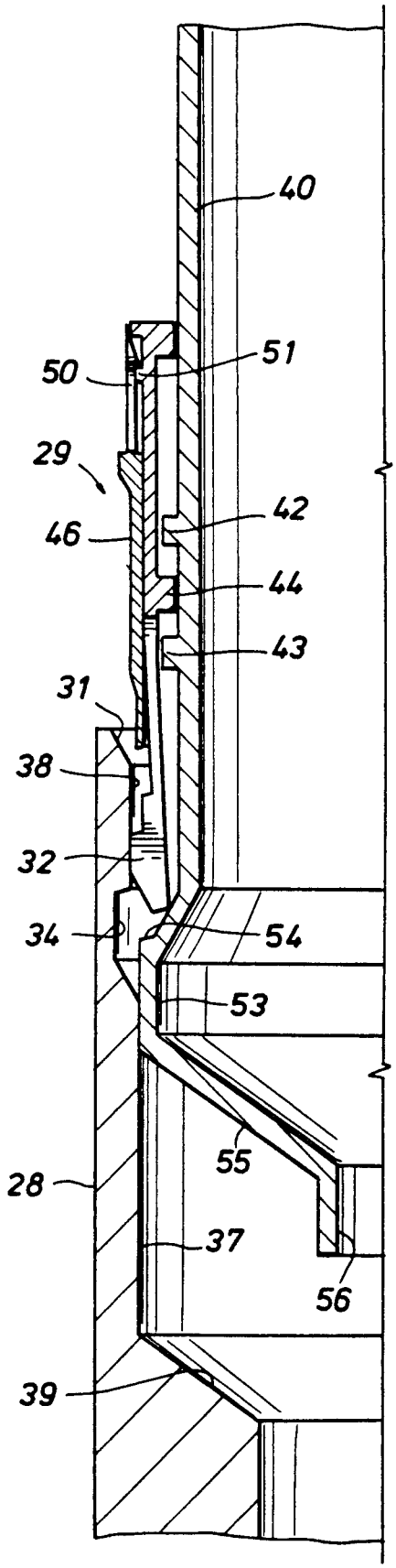

Alternatively, the latching mandrel 40 and the latching sleeve 41 may be released from a receptacle 28 by first lowering the mandrel 40 a few inches so that its locking shoulder 54 is no longer blocking the latch 32 in groove 34. Upward tension on the top 52 of the latching sleeve 41, as by a separate tool or line, possible with the assistance of an underwater vehicle, would pull the latch 32 out of the groove 32 (FIG. 12) and the mandrel 40 could then be withdrawn from the receptacle 28 (FIG. 13).

I claim as my invention:

1. For use with a floating tension-leg platform having a plurality of anchoring tendons extending from the platform with the lower ends of the tendons being connected in tension to anchor means fixedly secured to the ocean floor in deep water, said connection being made by underwater-actuatable and remotely-connectable and releasable tendon connector means, said connector means comprising first and second connector portions with said second portion adapted to be inserted into said first portion and to be slidably moved therein in an axial direction, said first connector portion forming a cylindrical receptacle having an open top end with the bottom end secured to said ocean floor anchor means, a first inwardly-directed camming surface formed around the upper end of said receptacle and adapted to be contacted by latches carried by the second connector portion for retracting the latches, a circumferential latching groove formed in the inner wall of said cylindrical receptacle and axially displaced from said first camming surface, a latching shoulder formed on the upper side of said latching groove adapted to seat latches against upward movement, a second camming surface formed on the lower side of said latching groove and being directed downwardly and inwardly, said cylindrical receptacle having a bore of reduced diameter below said latching groove, said second connector portion forming a tubular member adapted to be fixedly carried at the end of a tendon to be inserted downwardly into and latched in said first connector portion, a latching sleeve carried outwardly on said tubular member for limited axial movement thereon between spaced-apart stop means carried thereon, a plurality of depending collet spring fingers secured at their upper ends to the lower end of said latching sleeve for limited radial movement relative to the axis of said tubular element, outwardly-extending latches affixed to the free ends of the collet spring fingers, the diameter of the circle formed by the latches being equal to the diameter of the receptacle at the lower side of the latching groove, said cylindrical receptacle having a vertical bore therethrough for receiving said tubular element and the latching sleeve and radially movable latches carried thereby, said cylindrical receptacle bore having a bore extending below the first camming surface to the latching groove of a diameter to force the latches radially inwardly until they are moved downwardly to a position opposite the latching groove into which they are moved by the collet spring fingers, said receptacle bore adjacent to and below the termination of the latching groove being slightly reduced in diameter to force the latches radially to a second and further retracted position, and a latch hold-back sleeve carried outwardly on the latches of said latching sleeve and independently axially movable thereon between abutment means so as to drop by gravity into blocking engagement with said latches and against one of the abutment means to hold the latches in a radially retracted and inoperative state when the latches are forced into said second and further retracted position by the reduced bore portion of the receptacle, at which time the first and second connector portions of said connect means may be pulled apart.

2. The apparatus of claim 1 including an annular recess formed around the tubular member the latches into which recess the latches move when they are compressed radially.

3. The apparatus of claim 2 including outwardly-extending shoulder means formed on said tubular member and defining the bottom of said annular recess, and positioned below said latches to operatively contact said latches to exert pressure on the bottom of the latches when they operatively engage the latching groove of the receptacle when tension is applied upwardly to the tubular member.

4. The apparatus of claim 1 including stop means carried outwardly on said latch hold-back sleeve for engaging the top of the cylindrical receptacle and limiting further downward movement of said latch hold-back sleeve when said first connector portion is advanced into said second connector portion to thereby move said latches out of blocking engagement with said hold-back sleeve and upon axial outward movement of said first connector portion relative to said second connector portion said latches engage said latching shoulder.

5. The apparatus of claim 4 including second spring latch fingers carried by and extending upwardly from the top of said latch hold-back sleeve and a cooperating outwardly-extending latch ring carried on the outer surface of the latching sleeve near the upper end thereof whereby said second spring fingers are adapted to engage said latch ring and thereby restrain said hold-back sleeve out of contact with said latches.

6. The apparatus of claim 5 including stop means formed within the bore of said cylindrical receptacle below the latching groove for being engaged with the bottom of said tubular member after the stop means at the top of the latch hold-back sleeve has come in contact with the top of the receptacle.

7. For use with a floating tension-leg platform having a plurality of anchoring tendons extending from the platform with the lower ends of the tendons being normally connected in tension to anchor means fixedly secured to the ocean floor in deep water, underwater actuatable and remotely-connectable and releasable tendon connector means for connecting the lower end of each tendon to said anchor means, said connector means comprising first and second portions of said connector means coaxially slidably engageable one within the other, a first portion of said connector means having a vertical bore therein and being fixedly mounted on said ocean floor anchor means, a second portion of said connector means being secured to and carried by the lower end of a platform tendon to be anchored underwater, one of said portions of said connector means forming a cylindrical receptacle having at least one open end for receiving therein in sliding engagement the second portion of said connector means, a first inwardly-directed latch camming surface formed at the open end of the cylindrical receptacle into which the second portion of connector means is to be inserted, a circumferential latching groove formed in the inner wall of said cylindrical receptacle and axially displaced from said first camming surface, a second latch camming surface formed on one side of said latching groove and in the same direction as said first camming surface and terminating at a reduced-diameter portion of the receptacle bore, a latching shoulder formed on the other side of said latching groove, the other portion of said connector means comprising a tubular latch-carrying element of a size to fit within said cylindrical receptacle forming said one portion of said connector means, said cylindrical receptacle having movement-limiting stop means extending into the bore thereof for engaging the lower end of said tubular latch-carrying element, an annular recess formed in the outer wall of said tubular element for receiving latches therein, a latching sleeve carried outwardly on the outside of said tubular element for limited axial movement thereon between spaced-apart stop means carried thereon, a plurality of latching dogs carried on the ends of collet spring fingers for limited radial movement into the annular recess in said tubular element and subsequently into said latching groove to seat on said latching shoulder thereof in said cylindrical receptacle upon movement of the latching sleeve into said receptacle, and a latching-dog hold-back sleeve slidably mounted for gravity-actuated limited axial movement between abutment means on the outside of said latching sleeve, said hold-back sleeve being adapted to slide down over the latching dogs against one of the abutment means when they are forced radially into the annular recess in said tubular element upon continued axial movement of said tubular element into said cylindrical receptacle thereby allowing disconnection of said first and second connector means.

* * * * *